US006280681B1

(12) United States Patent
MacRae

(10) Patent No.: US 6,280,681 B1
(45) Date of Patent: Aug. 28, 2001

(54) FURNACE-WALL COOLING BLOCK

(76) Inventor: Allan J. MacRae, 1000 Silver Maple La., Hayward, CA (US) 94544

( * ) Notice: Subject to any disclaimer, the term of this patent is extended or adjusted under 35 U.S.C. 154(b) by 0 days.

(21) Appl. No.: 09/591,410

(22) Filed: Jun. 12, 2000

(51) Int. Cl.[7] ..... C21B 7/10
(52) U.S. Cl. ..... 266/193; 266/241
(58) Field of Search ..... 266/193, 194, 266/46, 241; 122/6 A, 6 B

(56) References Cited

U.S. PATENT DOCUMENTS 3,829,595 8/1974 Nanjyo et al. ..... 13/32
4,620,507 * 11/1986 Saito et al. ..... 122/6 B
5,676,908 10/1997 Kubbutat et al. ..... 266/193
5,904,893 5/1999 Stein ..... 266/46

* cited by examiner

*Primary Examiner*—Scott Kastler
(74) *Attorney, Agent, or Firm*—Richard B. Main

(57) ABSTRACT

A furnace-cooling block comprises a UNS-type C71500 schedule-40 water pipe cast inside a pour of electrolytic copper UNS-type C11000 de-oxidized during the casting process, or melted in an inert environment, to produce a high-copper approximating UNS-type C81100. A resulting fusion of the pipe to the casting is such that the differential coefficient of expansions of the two copper alloys involved does not exceed the yield strength of the casting copper during operational thermal cycling. The melting point of the copper alloy used in the pipe is such that a relatively thin-wall pipe may be used with a sand packing during the melt.

8 Claims, 3 Drawing Sheets

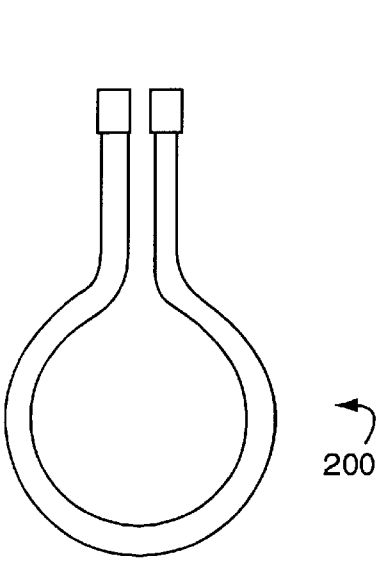
Fig. 2
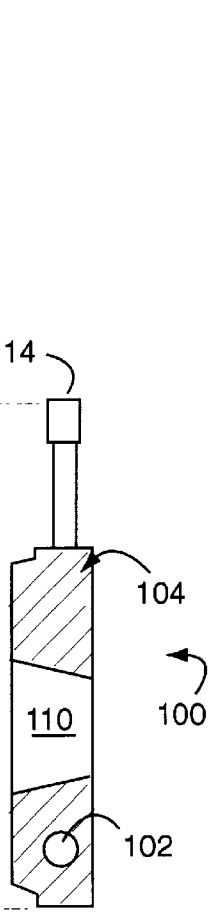
Fig. 1C
Fig. 1B
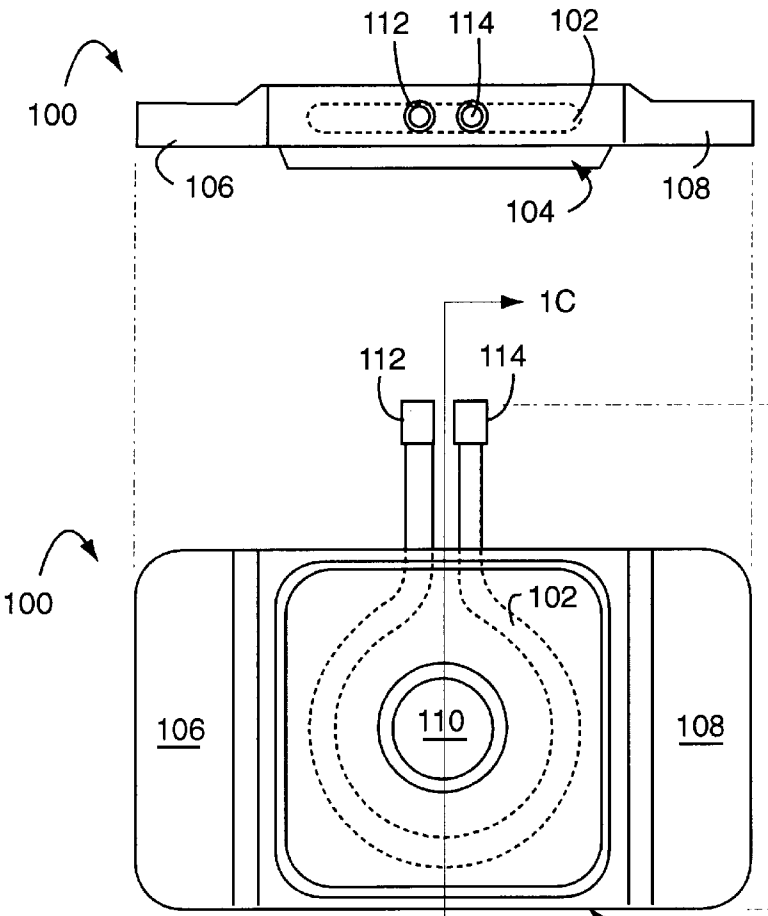
Fig. 1A

FURNACE-WALL COOLING BLOCK

BACKGROUND OF THE INVENTION

1. Field of the Invention

The present invention relates to furnace crucibles, and more particularly to the copper cooling blocks used behind refractory layers in the walls of the crucibles.

2. Description of Related Art

The high temperatures used in metal furnaces is enough to erode even brick-lined crucibles. Refractory materials are conventionally used to line the insides of crucibles, and the prior art has adopted the use of cooling blocks behind such linings. The operational result is a thin layer of the molten slag, matte and/or metal freezes on the walls and helps stabilize them against break-out. Such cooling blocks are also used for burner blocks, launders, tuyeres, staves, casting molds, electrode clamps, tap-hole blocks, and hearth anodes.

Most modern pyro-metallurgical furnaces use cooling systems to stabilize the unavoidable erosion of wall, roof and hearth refractories. Cooling blocks are typically arranged in a number of different ways. Walls, roofs and hearths that include them are used in cylindrical furnaces, oval furnaces, blast furnaces, Mitsubishi-style flash smelting and converting furnaces, IsaSmelt furnaces, electric arc furnaces, both AC and DC, basic oxygen furnaces, electric slag cleaning furnaces, rectangular furnaces, Outokumpu flash smelting and converting furnaces, Inco flash smelting furnaces, electric arc furnaces, slag cleaning furnaces, and reverbatory furnaces.

Cooling blocks can also be arranged in layers, with alternating courses of refractory. A refractory brick and/or castable refractory sometimes is used for the hot face of the block and may be smooth or have pockets and/or grooves machined or cast-in.

A problem develops when the cooling pipes and the metal castings are not the exact same materials. Different materials will have different coefficients of thermal expansion, and the strength of the bonding between the pipes and the castings will also vary. Constant thermal cycling can work the pipe loose of the casting, and when this happens the thermal efficiency drops significantly.

However, pipes made of materials with melting points that are higher than the molten casting metal are desirable because such resists softening or break-through during the casting pour. One prior art way to work around this problem is to tightly fill the pipes with sand so they are reinforced against collapse. Such sand is washed out after the casting has cooled.

Some combinations of cooling pipe and metal casting materials are known in the prior art as being able to provide at least an acceptable service life. For example, Falcon Foundry (Lowellville, Ohio) has produced Monel-400 pipes cast in copper cooling blocks since the 1960's. (Monel-400 is a trademark brand for an alloy of about 63% nickel and 31% copper.) Other companies, ElectroMelt (now defunct) and American Bridge (a former division of U.S. Steel), have designed cooling blocks utilizing Schedule-40 or Schedule-80 Monel-400 pipe coil assemblies which allow cooling chambers to be well defined. No cooling of the pipes is required during the casting pour of copper, as is normally the case with pure-copper pipes.

Unfortunately, failure analyses have shown that the copper cooling blocks are not in complete contact with the Monel-400 pipe. Many defects can be seen to exist when the blocks are destructively tested and the Monel-to-copper bond is evaluated. Such bonding defects reduce the thermal transfer efficiency and introduce unknowns into the overall furnace-cooling patterns.

Prior art cast copper and low-alloy-copper cooling blocks and design engineering have also been commercially supplied and/or designed by Hatch (Mississauga, Canada), Outokumpu OY (Finland), Kvaerner (Stockton, England), Demag (Germany), Hundt & Weber (Siegen, Germany), Tucson Foundry (Tucson, Ariz.), Thomas Begbie (South Africa), Alabama Copper (Alabama), Niagara Bronze (Niagara Falls, Canada), Hoogovens (Netherlands), and others.

Outokumpu, and others, design and manufacture copper cooling blocks from copper billet with longitudinal holes drilled for water passages. Extruded holes have also been used for the water passages, but some of these have been the subject of failures. Transverse drill holes with internal plugs have also been included to form internal cooling-water circuits.

The drilled and extruded designs all require plugs to be installed in all the open drill ends around the edges of the billet blocks. Solder, welded, and pipe-thread type plugs have all been tried. But many such blocks leak nonetheless, and such leaks are very dangerous in a metallurgical furnace.

The size and shape of such kinds of blocks is limited by the ability to cast or forge the copper billets. The internal water passage layout is often very constrained by having to fashion the passages from combinations of interconnected drill bores.

In contrast, cast blocks can be made in a wide variety of block shapes and sizes, and almost any layout is possible with the internal piping. Cast blocks can be used with much larger heat loads, compared to drilled and plugged blocks.

The fabrication of drilled blocks and cast blocks each present their own challenges. In casting, the water pipes can be both flow and pressure tested before and after. The danger of a leak through a copper cooling block with fabrication voids is very low because the pipe walls will contain the water.

Conventional cast cooling blocks are typically manufactured by forming a water pipe into a desired layout and pressure-testing it, before and after, to 150% of the design operating water pressure for at least fifteen minutes. Before the casting pour, the outside of the pipe is cleaned to minimize gas bubble formation that can result in porous casting sections at the pipe-coil and cast-copper interfaces. Sand is sometimes used to fill the inside of the pipes to stiffen them against softening, but only when using a pipe coil material that does not have a melting point significantly higher than the casting temperature of copper. For example, Monel-400 pipe does not ordinarily need to be packed with sand before casting.

The casting molds are made with extra allowances for machining off of porous sections, gates, risers, and shrinkage. Such molds are typically made from sand mixed with a bonding agent. The original shapes which are pressed in the sand are made from wood and other easily formed materials.

The pipe coils are securely located in the correct position inside the sand mold. Copper from a melting furnace is poured into a ladle. A de-oxidant may be necessary if the copper is melted in a non-inert environment. Any oxide slag is skimmed off. A sufficient superheat of the copper over its melting point is used to prevent the copper from prematurely solidifying during handling or pouring. The liquefied copper from the ladle must be sufficiently fluid to fill the mold, completely cover the pipe coils, and flow to the top of the risers. Any gas bubbles will rise high up to the surface of the risers.

Once the deoxidized copper is poured into the mold from the ladle, the casting is allowed to cool until it has totally solidified. The risers and gating systems are mechanically removed. Any excess material is machined or cut away, and hot-face grooves and/or pockets are formed or finished. On the outside surface, the holes are drilled and tapped for either locating, mounting or block lifting. The mating surfaces, between blocks, are normally machined. The amount of machining needed is dependent on the end use for the block.

Any surface imperfections may or may not be repaired, depending on the requirements of the end user. Such imperfections are ground out, weld filled, and machined smooth. The completed blocks are inspected using one or more inspection x-ray, visual inspection, infrared-thermal inspection, and hydrostatic or pneumatic pressure testing for leaks. Thermal and/or electrical testing is used to check that the block meets minimum thermal and electrical conductivity. Dimensional tolerances are also checked. Samples can be used in a destructive testing program, a predetermined percentage of the total number of identical or similar blocks to be manufactured are cut open and inspected.

Cooling blocks with steel and/or iron pipes and tubes cast inside copper have several advantages. The pipe coil is inexpensive and very easy to manufacture, bend, weld, and join with fittings. Steel and iron pipe coils do not melt when the molten copper is poured into the mold. The resulting blocks have well-defined water passages.

But the disadvantages include gas bubbles, porosity, gaps, and poor pipe-to-casting fusion. Such defects are detectable with x-ray and destructive testing. Cast copper does not form a good metallurgical bond with the outside of steel and iron pipes. Destructive testing shows such pipes separate easily from the cast copper. Samples are usually sliced up 0.25 to 1.00 inches thick to expose pipe cross sections. Cutting across through the slice so that the pipe is not mechanically locked in will usually confirm the poor steel-to-copper bond. Such pipes often fall out before a pneumatic chisel is applied.

Heat transfer from the copper to the pipe is reduced, due to lack of fusion and frequent defects at the pipe-copper interface. So the cooling block tends to run hotter than versions that use copper pipes. The much lower thermal conductivity of steel and iron in the pipe only exacerbates this inefficiency. The thermal conductivity of steel is about 33 BTU/hr/° F. compared to 226 BTU/hr/° F. for electrolytic copper, a seven-fold difference.

There are also large differences in the coefficients of thermal expansion between the steel in the pipes and the cast copper. Stresses at the pipe-copper interface easily exceed the copper yield-stress, so the copper in the block will crack under thermal cycling. The coefficients of thermal expansion are about $6.9\times10^{-6}$ in/in/° F. for steel, and $9.8\times10^{-6}$ in/in/° F. for UNS C81100 cast copper.

Stainless steel pipes or tubes with copper cast around them have more advantages. Stainless steel pipe coil is only slightly more expensive than steel or carbon pipe, and is about as easy to manufacture, bend, weld, and make fittings. The stainless steel pipe coil will not melt when molten copper is poured into a mold. The resulting block has a well-defined water passage. The disadvantages are less pronounced and less frequent, but gas bubbles, porosity, gaps and other signs of lack of fusion are common at the interface of the pipe with the copper.

Here too, the cast copper does not form a good metallurgical bond to the outside of the stainless steel pipe. Destructive tests prove the stainless steel pipe is also easily removed from the cast copper. The thermal conductivity of stainless steel is much worse than steel, e.g., only about 9.4 BTU/hr/° F. The coefficient of thermal expansion for stainless steel is about $9.6\times10^{-6}$ in/in/° F., compared to $9.8\times10^{-6}$ in/in/° F. for UNS C81100 cast copper.

Monel-400 pipe or tube when cast inside copper cooling blocks has the advantage that the Monel-400 will not melt when the molten copper is poured into the mold. So the resulting block will have a well-defined water passage. Molten copper wets Monel-400 very well. So the pipe coil and copper casting will form a tight intimate interface. However, Monel-400 pipe coil is the most expensive pipe coil commercially used with cast copper. It is much more difficult to manufacture.

Even so, the cast copper does not normally form a good metallurgical bond with the outside of the Monel-400 pipe. A pneumatic chisel can usually separate the two in destructive tests. Once separated, copper particles over the Monel-400 pipe cover less than 10% of the total surface area. At least 90% of the surface area of the typical Monel-400 pipe section is not bonded mechanically or metallurgically.

Cooling blocks made with Monel-400 pipe represent about 30% of the cost of the casting. Standard returns and fittings in Monel-400 are more difficult to obtain than their counterparts in stainless steel, carbon steel, or iron pipe. Some distortion of the Monel-400 pipe coil is typical during casting, but is not significant. Stiffening the Monel-400 pipe coil with a sand mixture is not usually needed. Gas bubbles, porosity, gaps and other signs of lack of fusion are not common at the interface of the pipe with the copper, provided adequate steps are taken for surface cleanliness of the pipe coil.

Heat transfer from the copper to the Monel-400 pipe is limited by the lack of metal fusion at the pipe-copper interface. The differences in the coefficients of thermal expansion are still too great between the Monel-400 pipe coil and the cast copper. The state of stress at the Monel-400 copper interface will exceed the yield stress of the copper, even at moderate thermal loads. Progressive failure will occur under thermal cycling. The coefficient of thermal expansion for Monel-400 is about $7.7\times10^{-6}$ in/in/° F., compared to $9.8\times10^{-6}$ in/in/° F. for UNS C81100 cast copper. Monel-400 pipe in cast copper cooling blocks can give good service in near steady-state operations.

Pure-copper pipe coil is less expensive than Monel-400, but more expensive than carbon steel or iron pipe. It is relatively easy to manufacture, bend, weld, etc. The resulting cooling block has a well-defined water passage, and considerable bonding of the cast copper to the copper pipe can occur.

The resulting copper cooling block tends to run the coolest of all, provided that the cast copper has bonded to the outside of the pure-copper pipe coil. The interface of the pipe coil with the cast copper is quite good, the prior art does not ordinarily obtain such metallugical bonding.

But the pure-copper pipe coil will soften or melt if used in large castings. The pipe coil must be cooled during the casting pour when fabricating moderate to large size blocks. A melt-through of the pipe is a strong possibility, particularly at any corners. Uneven cooling during casting and the thinner walls on the outsides of the pipe bends contribute to melt-through. The pure-copper pipe coil must have much thicker walls than any other type of pipe coil. The equivalent of a Schedule-120 or Schedule-160 is normally used, compared to Schedule-40 or less for the other pipe coil types.

An adverse consequence of the thicker walls is the center-to-center spacing of water passages must be much larger. The surface area of water within the block will be reduced. The equilibrium heat removal capacity is diminished compared to Monel-400 and steel alloy pipe materials. The amount of cooling required during casting is based on considerable foundry experience.

Gas bubbles, porosity, gaps, and other signs of a lack of metal fusion can still occur at the interface of the pipe with the copper, but to a much lesser extent than with either steel or iron pipes. If too much cooling of the pipes during the casting pour is used, a good metallurgical bond to the outside of the pipe will not occur. But if too little cooling is used, a melt-through can occur in the walls of the copper pipe. Such melt-throughs can obstruct the cooling water flow, and the cooling block will be unusable. If the molten copper melts through the pipe and contacts the cooling medium during the casting pour, a dangerous explosion can occur.

Pure-copper pipe in cast-copper cooling blocks provides good service for moderate and cyclic thermal loading, but only if the block is well made.

Sand cores can be used instead of pipe to define water passages within a copper casting, e.g., the way automobile engine blocks are made. The sand is blended with an organic binder, and the technique is much less expensive than using internal preformed metal pipe coils. The resulting blocks can have well-defined water passages, and the sand is easily removed after the casting has solidified. The cooling water is in intimate contact with the cast copper cooling block, and this maximizes heat transfer.

But parts of the sand may dislodge during casting and ruin the water containment. The design of the water passages is much less flexible than with preformed pipe coils because the sand cores must be mechanically supported. Extensive foundry experience is required to make such castings. Gas bubbles, porosity, gaps and fusion defects can occur. The inside of the water passages are not as smooth as with pipes, and this leads to higher hydraulic gradients. Larger supply pumps and piping are often needed. The reject rate of cast blocks with sand cores is higher than those with pipes having high melting point materials.

The lack of an internal pipe coil increases the risk of a potential leak. Steel vent/support pipes for the sand cores must be sealed using a plug and/or welding. The casting will fill with gas bubbles if there are no vents. The support pipes are necessary, as the sand cores would sag otherwise. These steel pipes can also be a source of porosity, or through-thickness defects.

The sand-core cast copper cooling blocks tend to run the coolest of all types. Such provide good service for moderate and cyclic thermal loading, provided that the block is well made.

A typical cooling block comprises steel or copper water pipe filled with sand and cast inside a block of steel or copper. For example, U.S. Pat. No. 5,904,893, issued May 18, 1999, to Ulrich Stein, describes a plate cooler for iron and steel industry metallurgical furnaces, blast furnaces, direct reduction reactors, and gassing units with refractory linings. A pattern of thick-walled copper pipes is arranged inside a mold, and molten copper is poured into the mold. The use of a few different copper alloys are also discussed. Intimate bonding of the cast copper block to the cooling pipe is needed to maintain the thermal efficiency of the cooling block. A slight melting of the thick-walled pipes is said to occur during the pouring of the molten copper around the pipeline, and thus bonds them in the casting.

An Aug. 13, 1974, U.S. Pat. No. 3,829,595, by Nanjyo, et al., illustrates a cross-section of an electric direct-arc furnace with cooling blocks in the walls. This and all other Patents mentioned herein are incorporated by reference. The cooling blocks are described as specially cast steel with steel water-cooling tubes. Refractory brick is locked in horizontal grooves cut in the hot faces of the cooling blocks to mechanically stabilize them and improve heat transfer.

A shaft furnace cooling plate is described by Axel Kubbutat, et al., in U.S. Pat. No. 5,676,908, issued Oct. 14, 1997. Such cooling plate is used behind a refractory lining and is described as an improvement over prior art devices made of cast iron. It also criticizes cast copper cooling plates as having a lesser ability to conduct heat compared to denser forged or rolled stock copper. So a furnace-cooling plate is taught with reinforced head ends that are integrated into the cooling system.

Ulrich Stein describes a plate cooler in U.S. Pat. No. 5,904,893, issued May 18, 1999. Cast copper is used with a low-alloy copper. Both webbed/grooved and smooth surfaced cooling plates are mentioned. The fact that pure copper pipes are being used causes Ulrich Stein to caution that pipes with walls thicker than are commercially available must be used. Column 3, line 65, to column 4, line 3. About 1–5 mm of the pipe walls melt after the casting pour.

A typical casting pour will overfill the mold so that impurities will float off. A porous top layer that forms, can be milled away down to the final dimensions needed. The pipe cast inside is pressure-tested before and after. A typical cooling block can weigh as little as two pounds to as much as several tons, depending on the furnace application.

What is needed is a cooling block that can be made from readily obtainable and relatively inexpensive commercial materials, and yet achieves strong fusion between the piping and the casting. The differential coefficient of expansion must also be such that high heat loads and constant thermal cycling can be tolerated over the operational lifetime without cracking or other materials failures.

SUMMARY OF THE INVENTION

An object of the present invention is to provide a cooling block that can tolerate high heat loads and constant thermal cycling over its operational lifetime.

Another object of the present invention is to provide a cooling block that can be manufactured from readily obtainable and relatively inexpensive commercial materials.

A further object of the present invention is to provide a cooling block in which the internal piping can assume tight smooth bends without resorting to reversing caps, internal plugs, elbows, or other fittings with sharp corners that can fail during casting.

Briefly, a furnace-cooling block embodiment of the present invention comprises a UNS-type C71500 Schedule-40 water pipe-cast inside a pour of electrolytic copper UNS-type C11000 de-oxidized during the casting process to produce a high-copper approximating UNS-type 81200. A resulting fusion of the pipe to the casting is such that the differential coefficient of expansions of the two copper alloys involved does not exceed the yield strength of the casting copper during operational thermal cycling. The melting point of the copper alloy used in the pipe is such that a relatively thin-wall pipe may be used with a sand packing during the melt.

An advantage of the present invention is that a furnace-cooling block is provided that has a low thermal resistance between the hot face and cooling water circulating during operation in the piping.

Another advantage of the present invention is that a furnace-cooling block is provided that can be used in high heat load and thermal cycling applications.

A still further advantage of the present invention is that a furnace-cooling block is provided that is inexpensive to manufacture.

The above and still further objects, features, and advantages of the present invention will become apparent upon consideration of the following detailed description of specific embodiments thereof, especially when taken in conjunction with the accompanying drawings.

BRIEF DESCRIPTION OF THE DRAWINGS

FIGS. 1A, 1B and 1C are end, top, and side projections of a furnace-cooling system embodiment of the present invention;

FIG. 2 is a plan view diagram of a pipe loop like that used in the furnace-cooling system of FIGS. 1A–1C;

DETAILED DESCRIPTION OF THE INVENTION

Figure 3:
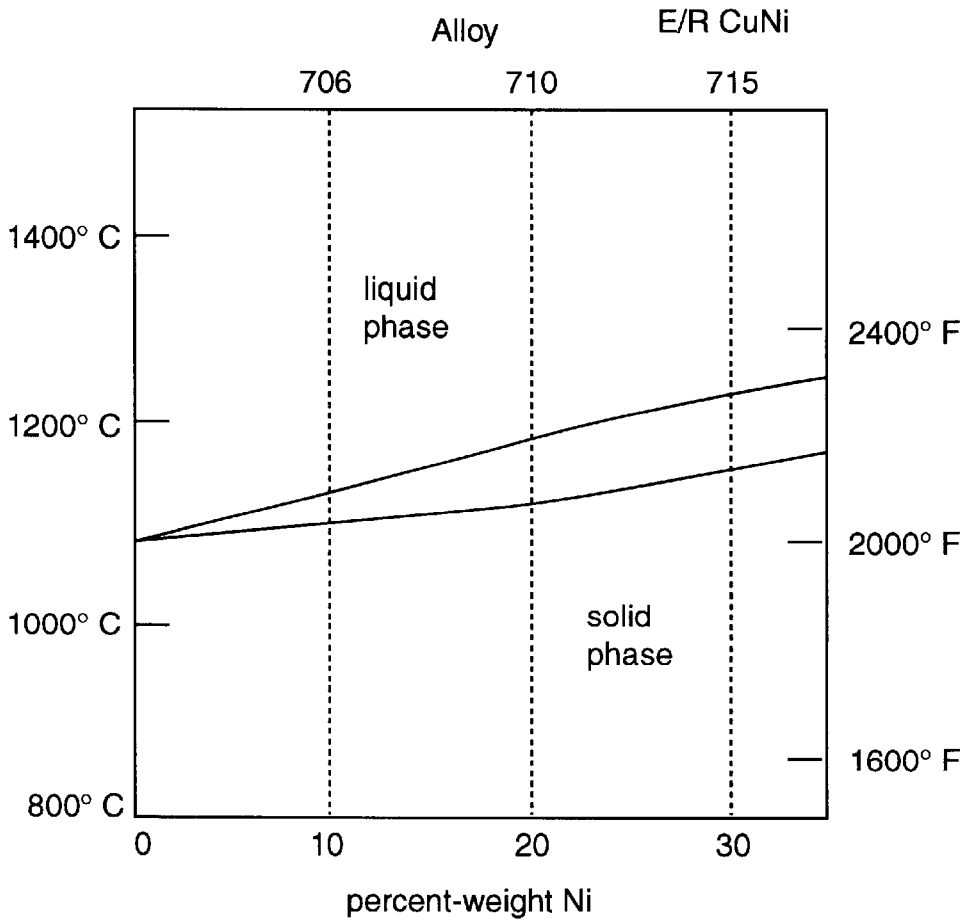
FIG. 3 is a copper-nickel phase diagram, and shows that UNS-type C71500 alloy will begin to melt at about 1125° C. (2150° F.)
Figure 4B:
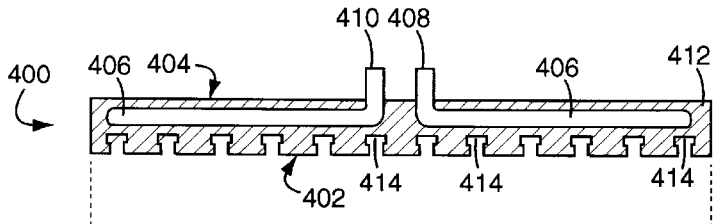
FIGS. 4A, 4B, 4C and 4D are top, longitudinal cross-section, bottom, and lateral cross-section diagrams of a cooling block embodiment of the present invention.
Figure 4A:
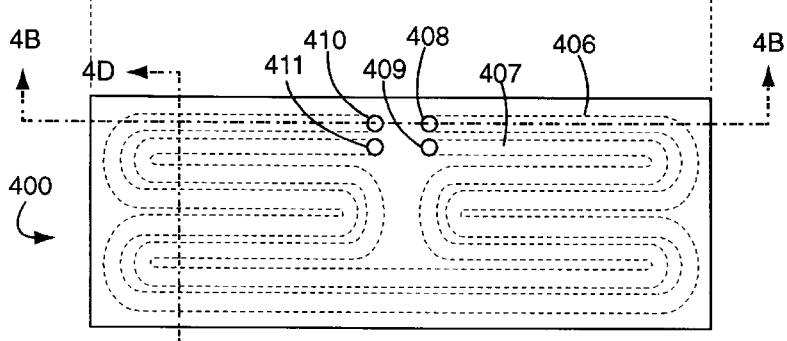
Figure 4C:
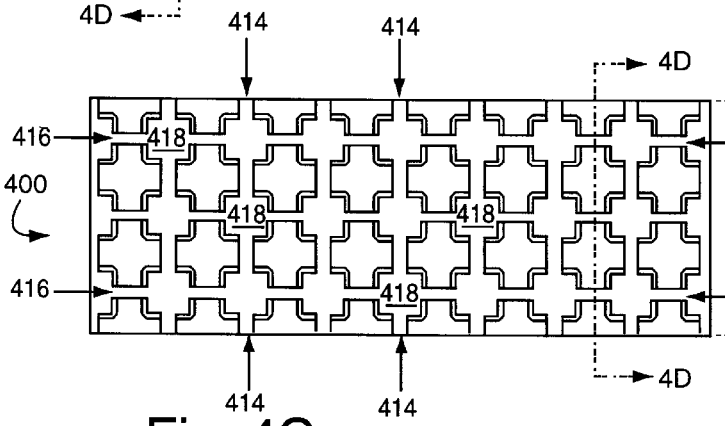
Figure 4D:
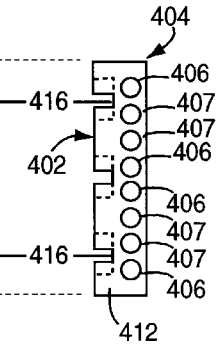

FIGS. 1A–1C represent a furnace-cooling system embodiment of the present invention, and is referred to herein by the general reference numeral 100. The furnace-cooling system 100 comprises a pipe 102 bent into a loop and cast inside a cooling block 104. A pair of flanges 106 and 108 allow for mounting of the furnace-cooling system 100 in a foundry furnace crucible. A conical hole 110 provides a secure way to mount a refractory casting or brick that lines the inner walls of such crucibles. A pair of pipe fittings 112 and 114 provide connections for a water-cooling circulation system.

The pipe 102 preferably comprises UNS-type C71500 copper-nickel alloy and is filled with sand to prevent collapse during casting of the block 104. (The UNS-type C71500 copper-nickel alloy is also called number-715 by the Copper Development Association.) The cooling block is preferably cast with UNS-type C11000 electrolytic copper which is de-oxidized during the casting process. That ultimately produces a casting with a high-copper alloy equivalent to UNS-type 81200. In alternative embodiments, a casting with a high-copper alloy equivalent to UNS-type 81100 is produced.

FIG. 2 illustrates a pipe loop 200 of UNS-type C71500 copper-nickel alloy before it is cast inside a cooling block. Such is degreased and deoxidized thoroughly before the casting operation to ensure good fusion and bonding. Pure copper melts at about 1980° F. and ordinarily requires preheating when welding, so it may be advantageous to preheat the pipe loop 200 just before it is cast inside the block. Preheating also helps to evaporate water moisture from both the mold and the pipe coil.

FIG. 2 shows a pipe loop 200 made of one piece of smooth-wall pipe bent to the desired shape. If the required pattern was not possible to construct that way, then pipe fittings would be needed. Such fittings must be welded-on with any sharp edges ground down. Otherwise, the joints will collect occlusions in the casting or act to generate voids.

In destructive tests that were conducted on a prototype of the furnace-cooling system 100, the block 104 was cut to expose about 25% of the pipe coil 102 circumference and sliced into a five-eighths inch long piece. A pneumatic chisel was used in an attempt to dislodge the pipe from the copper. The pipe remained fused to the cast copper. In previous attempts with the prior art devices using other nickel-copper alloys or Monel-400 for the pipe coil, it was often possible to dislodge the pipe coil segment from the cast copper with no more than the chisel.

A scanning electron microscope (SEM) used at the Cominco Research facility in Trail, British Columbia, Canada, found that grains of the cast copper were metallurgically bonded to the pipe copper. Such welding prevented the UNS-type C71500 copper-nickel alloy pipe from being dislodged from the cast copper. Such a good metallurgical bond is not normally observed in any prior art coil materials, e.g., copper pipe, Monel-400 pipe, etc.

The approximate composition of UNS-type C71500 is given in Table I.

TABLE I

| material | Ni | Pb | Fe | Zn | Mn | Cu |
|---|---|---|---|---|---|---|
| W % | 29.0–33.0 | 0.05 | 0.4–0.7 | 1.0 | 1.0 | remainder |

Even though UNS-type C71500 copper alloy is less likely to be contaminated by handling and storage than Monel-400, the same precautions and cleaning procedures conventional for Monel-400 are preferably used in making embodiments of the present invention. For example, the pipe must not be handled with bare hands and should be laid on cardboard. Monel-400 tends to pick-up iron very easily. Contaminants left on the pipe during casting will convert to gases that result after solidification in porosity in the copper casting.

FIG. 3 is a copper-nickel phase diagram, and shows that UNS-type C71500 alloy will begin to melt at about 1125° C. (2150° F.). The melting point of Monel-400 is only slightly higher than that. So good interface fusion is obtained without much in the way of a sacrifice in the melting point.

In embodiments of the present invention, the usual stresses at the interface of the pipe with the cast copper do not exceed the yield stress for the cast copper, based on three-dimensional finite element thermo-mechanical stress analyses. Cyclic loading applications are, therefore, permissible. The coefficient of thermal expansion for UNS-type C71500 copper-nickel alloy is about $9.0\times10^{-6}$ in/in/° F., and $9.8\times10^{-6}$ in/in/° F. for UNS C81100 cast copper. The differential is, therefore, only $0.8\times10^{-6}$ in/in/° F. The yield strength of cast copper is about 9.0 ksi, and 30–40 ksi for Monel-400.

ASTM Schedule-40 pipe, or thinner, can therefore be used for the UNS-type C71500 copper-nickel alloy pipe coils. Tighter water passage spacing is possible. The commercial cost is less than Monel-400 pipe. The finished copper casting will run cooler due to the higher thermal conductivity of the new alloy compared to Monel-400.

The lower melting temperature of UNS-type C71500 copper-nickel alloy, compared to Monel-400, means the preformed pipe coils must be packed with a mixture of sand mix and organic binder to stiffen the pipes during the casting process. However, cooling is critically not required. If the pipe coils are-not stiffened with sand, they will either sag or sections will bend and move too close the hot face of the block. Either occurrence can render the cooling block unusable. The sand mix is removed after the casting has solidified.

In general, embodiments of the present invention strike a balance between the differential melting points, and the differential coefficients of expansion of the pipe and casting materials. High differential melting points are needed so the pipe does not melt or soften during casting, and so thin-wall pipes can be used that can be formed easily. But low differential coefficients of expansion of the pipe and casting materials are needed so that the yield strengths of the materials are not exceeded during operational thermal cycling. Copper alloys are, in general, preferred for the pipe and casting materials because of their superior thermal conductivity compared to material cost.

Therefore, the respective copper-alloys used in the pipe and casting must be sufficiently different to result in a maximal differential melting point, and sufficiently the same to result in a minimal differential coefficient of expansion. Given these general constraints, an empirical solution has been to make embodiments of the present invention with UNS-type C71500 copper-nickel alloy, and the casting with UNS C81100 cast copper. The thermal conductivity of the copper predominates, and the yield strength at the fused interface are not over-stressed by operational thermal cycling. Other UNS-type alloy combinations could no doubt be satisfactory, but these will all necessarily meet the general constraints mentioned herein.

The yield strengths of the pipe and casting both degrade as the copper content of the respective alloys increases. For example, the maximum copper casting stress at the pipe interface is almost linearly proportional from 8000 PSI at 30%-W copper to 2000 PSI at 100%-W copper. The maximum pipe stress is almost linearly proportional from 14000 PSI at 30%-W copper to 2000 PSI at 100%-W copper.

TABLE II

| Cu % - W | A | B | C | D | E | F |
|---|---|---|---|---|---|---|
| 100 | 135 | 114 | 325 | 2228 | 2228 | 2 Grooves |
| 70 | 158 | 115 | 349 | 5662 | 8195 | 2 Grooves |
| 30 | 161 | 115 | 352 | 8303 | 14203 | 2 Grooves |
| 70 | 158 | 115 | 229 | 5642 | 8166 | Pockets |

For an applied heat flux of 50,000 BTU/Ft$^2$/hr:
A =pipe temperature ° F., external;
B =pipe temperature ° F., internal;
C =copper temperature ° F., tip;
D =copper stress (PSI), at pipe;
E =pipe stress (PSI);
F =surface type.

FIGS. 4A–4D illustrate a cooling block embodiment of the present invention, and is referred to herein by the general reference numeral 400. The cooling block 400 includes a hot-face 402 opposite to a plumbing face 404. A pair of UNS C71500 copper-nickel alloy pipes 406 and 407 are fitted with respective pipe couplings 408–411. The pipes 406 and 407 are cast inside a solid-copper block 412. FIGS. 4A–4D show a typical pattern. A system of vertical grooves 414, horizontal grooves 416, and pockets 418 at the intersections are included in the hot face 402. Such provide sites to retain refractory and/or frozen bath material. The use of any of the vertical grooves 414, horizontal grooves 416, and pockets 418, as well as their shapes and placement are a matter of engineering choice made for each particular application. The fabrication of the cooling block 400 is similar to the furnace-cooling system 100 of FIG. 1.

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. A furnace-cooling system, comprising:

a pipe coil comprising a copper-nickel alloy comprising at least 60%-Wt copper, and for providing a cooling-water passage; and a furnace-cooling block comprising a copper alloy comprising at least 50%-Wt copper;

wherein a circuit of the pipe coil is not cooled when being cast inside the furnace-cooling block.

2. A furnace-cooling system casting combination as it exists during its fabrication, comprising:

a pipe coil comprising a copper-nickel alloy comprising at least 60%-Wt copper, and for providing a cooling-water passage;

a furnace-cooling block comprising a copper alloy comprising at least 50%-Wt copper;

a packing of sand that fills the pipe coil during casting of the furnace-cooling block; and wherein a circuit of the pipe coil is not cooled when being cast inside the furnace-cooling block.

3. A furnace-cooling system, comprising:

a pipe coil comprising a UNS C71500 copper-alloy and for providing a cooling-water passage; and a furnace-cooling block made of a material that starts as a high purity copper equivalent to UNS C1100 cast inside a mold, and that ends with an approximation of UNS C81100;

wherein a circuit of the pipe coil is not cooled when being cast inside the furnace-cooling block.

4. The furnace-cooling system of claim 3, wherein:

the pipe coil has a maximum wall thickness equivalent to ASTM Schedule-40.

5. The furnace-cooling system of claim 3, wherein:

any stresses at an interface of the pipe coil with the furnace-cooling block of cast copper does not exceed a yield stress for the cast copper, based on three-dimensional finite element thermo-mechanical stress analyses, under design thermal loading.

6. The furnace-cooling system of claim 3, wherein its constituent materials strike a balance between respective differential melting points and corresponding differential coefficients of expansion of a pipe and its surrounding cast materials, wherein a high differential melting point is required so said pipe does not melt or soften during a casting, and so a thin-wall pipe can be used that can be formed easily, and a low differential coefficient of expansion of said pipe and casting materials is required so that any yield strength of said constituent materials are not exceeded during a later operational thermal cycling.

7. A furnace-cooling system comprising:

a plurality of constituent materials that strike a balance between respective differential melting points and corresponding differential coefficients of expansion of a pipe and its surrounding cast materials, wherein a high differential melting point is required so said pipe does not melt or soften during a casting, and so a thin-wall pipe can be used that can be formed easily, and a low differential coefficient of expansion of said pipe and casting materials is required so that any yield strength of said constituent materials are not exceeded during a later operational thermal cycling; and copper alloys are used for said pipe and casting materials;

wherein, respective copper-alloys used in said pipe and casting are sufficiently different to result in a maximal differential melting point, and sufficiently the same to result in a minimal differential coefficient of expansion.

8. The furnace-cooling system of claim 7, wherein:

said constituent materials comprise only UNS C71500 copper-nickel alloy and UNS C81100 cast copper.

* * * * *